US006186821B1

(12) United States Patent
Mullen, Jr.

(10) Patent No.: US 6,186,821 B1
(45) Date of Patent: Feb. 13, 2001

(54) HERMAPHRODITIC CABLE CONNECTOR

(75) Inventor: Thomas M. Mullen, Jr., Dunellen, NJ (US)

(73) Assignee: Heyco Products, Inc., Toms River, NJ (US)

( * ) Notice: Under 35 U.S.C. 154(b), the term of this patent shall be extended for 0 days.

(21) Appl. No.: 09/314,415

(22) Filed: May 18, 1999

Related U.S. Application Data

(60) Provisional application No. 60/086,064, filed on May 20, 1998.

(51) Int. Cl.[7] ..... H01R 11/20
(52) U.S. Cl. ..... 439/409; 439/399
(58) Field of Search ..... 439/409, 410, 439/467, 407, 399, 398, 400

(56) References Cited

U.S. PATENT DOCUMENTS

| | | | | |
|---|---|---|---|---|
| 4,163,598 | * | 8/1979 | Bianchi et al. | 439/459 |
| 4,413,872 | * | 11/1983 | Rudy, Jr. et al. | 439/467 |
| 4,461,528 | * | 7/1984 | Durand et al. | 439/409 |
| 5,435,747 | * | 7/1995 | Franckx et al. | 439/409 |

OTHER PUBLICATIONS

"Cross Over Connector" by Molex–Etc Inc., undated.
"Non–Metallic Cable Splices and Tap" by AMP Connect, General Information, undated.

* cited by examiner

*Primary Examiner*—Brian Sircus
*Assistant Examiner*—Son V. Nguyen
(74) *Attorney, Agent, or Firm*—Selitto & Associates

(57) ABSTRACT

The present invention relates to a connecting device adapted for connecting an electrical cable, which includes wires, to a similar or identical electrical cable. The device includes a housing having a connecting end, which is adapted to be removably connected to a connecting end of an identical connecting device, and an opposite end, which includes a slot for receiving an electrical cable inserted into the housing. The housing also includes a receiving portion at the connecting end for receiving a plurality of connecting blades adapted to engage blades of an identical device and to receive wires of an electrical cable inserted into the housing through an open side thereof. A cover is provided for covering the open side of the housing. The cover is pivotally connected to the housing remote from the opposite end thereof such that the cover is pivotally movable relative to the housing between an open position, in which the open side of the housing is substantially unobstructed by the cover for insertion of electrical wires into the blades, and a closed position, in which the open side of the housing is substantially closed off by the cover. The slot is unobstructed by the cover when the cover is in the open position, whereby an electrical cable inserted into the housing can be laid in the slot while the cover is attached to the housing and then secured to the housing in response to the pivotal movement of the cover from the open position to the closed position.

26 Claims, 14 Drawing Sheets

HERMAPHRODITIC CABLE CONNECTOR

CROSS REFERENCE TO RELATED APPLICATIONS

This is a §111(a) application relating to U.S. application Ser. No. 60/086,064 filed May 20, 1998.

FIELD OF THE INVENTION

The present invention relates to electrical connectors and more particularly to a hermaphroditic device for coupling and uncoupling interlinking cables.

BACKGROUND OF THE INVENTION

Hermaphroditic type electrical connectors are electrical connectors which are mateable with identical electrical connectors. Hermaphroditic type cable connectors are used in the construction of modular housing and recreational vehicles in a factory environment.

Existing hermaphroditic cable connectors have certain drawbacks. These drawbacks include connectors which require multiple steps to attach two separate pieces of the connector to a cable. The first step generally involves connecting the cable to one piece of the connector to form a sub-assembly. The second step involves connecting another piece of the connector to the sub-assembly to complete the full assembly.

Another drawback of existing hermaphroditic connectors is potentially inefficient insulation displacement contacts resulting in higher resistance and increased voltage drop. Uncoupling of mated hermaphroditic connectors attributable to inadvertent triggering of the unlocking mechanism is also a potential problem. Relatively large size is another drawback of some hermaphroditic connectors.

SUMMARY OF THE INVENTION

The present invention overcomes the disadvantages and shortcomings of the prior art discussed above by providing a new and improved connecting device adapted for connecting an electrical cable, which includes a plurality of wires, to a similar or identical electrical cable. More particularly, the device includes a housing having an open side for insertion of an electrical cable into the housing, a connecting end, which is sized and shaped so as to be removably connected to a connecting end of an identical connecting device, and an opposite end, which includes a receiving slot for receiving at least a portion of an electrical cable inserted into the housing. The housing includes a blade receiving mechanism, located adjacent the connecting end, for receiving a plurality of connecting blades sized and shaped so as to engage connecting blades of an identical connecting device and to receive wires of an electrical cable inserted into the housing. The device also includes a cover for covering the open side of the housing. The cover is pivotally connected to the housing remote from the opposite end thereof such that the cover is pivotally movable relative to the housing between an open position, in which the open side of the housing is substantially unobstructed by the cover for insertion of wires of an electrical cable into the blades, and a closed position, in which the open side of the housing is substantially closed off by the cover. The receiving slot is unobstructed by the cover when the cover is in the open position, whereby an electrical cable inserted into the housing can be laid in the receiving slot while the cover is attached to the housing and then secured to the housing in response to the pivotal movement of the cover from the open position to the closed position.

In accordance with one feature of the present invention, the opposite end of the housing includes an end wall. The slot is formed in the end wall and has an open end adjacent the open side of the housing for receiving an electrical cable inserted into said housing when the cover is in the open position. The cover also includes a first end, which is pivotally connected to the connecting end of the housing, and a second end, which is located opposite the first end. The open end of the slot is unobstructed by the second end when the cover is in the open position and abutted by the second end when the cover is in the closed position. The housing also includes a pair of pivot pins, while the cover includes a pair of hinges, each of which is sized and shaped so as to rotatably receive a corresponding one of the pivot pins.

Another feature of the present invention involves providing a gripping mechanism for gripping an electrical cable inserted into the housing in a strain-relieving manner in response to pivotal movement of the cover from the open position to the closed position. More particularly, the gripping means includes a gripping member formed on the cover and sized and shaped so as to urge an electrical cable positioned in the slot against the end wall when the cover is pivotally moved from the open position to the closed position.

In accordance with yet another feature of the present invention, each of the blades includes a wire receiving mechanism for receiving an end of a wire of an electrical cable inserted into the housing. Each of the wire receiving mechanisms is sized and shaped so as to retain a wire of an electrical cable received therein in proper position relative to the housing while the cover is pivotally moved from the open position to the closed position. Each of the blades also includes a piercing channel, which is formed on a receiving end thereof, and a chamfered edge so as to improve penetration of wire insulation and to insure reliable electrical contact between the blades and wires.

In accordance with another feature of the present invention, the blade receiving mechanism includes a plurality of receiving channels formed in the housing adjacent the connecting end thereof. Each of the receiving channels is sized and shaped so as to receive a corresponding one of the blades. The housing is also provided with a retaining mechanism, including notches which are formed in partitions defining the receiving channels, for retaining each of the blades in a corresponding one of the receiving channels.

According to yet another feature of the present invention, the device is provided with a locking mechanism for releasably locking the connecting end of the housing to a connecting end of an identical connecting device. More particularly, the locking mechanism includes a first locking member and a second locking member formed on the housing adjacent the connecting end. The first locking member is sized and shaped so as to releasably interlock with a second locking member of an identical connecting device, while the second locking member is sized and shaped so as to releasably interlock with a first locking member of an identical connecting device. The housing includes a base having a depression therein adjacent the connecting end of the housing. The first locking member is formed on the base in such a manner that a second locking member of an identical connecting device interlocked to the first locking member is substantially tucked in the depression, thereby inhibiting inadvertent disengagement of the first locking member from an interlocked second locking member of an identical connecting device.

BRIEF DESCRIPTION OF THE DRAWINGS

For a better understanding of the present invention, reference is made to the following detailed description of exemplary embodiments considered in conjunction with the accompanying drawings, in which.

DETAILED DESCRIPTION OF THE INVENTION

Figure 1:
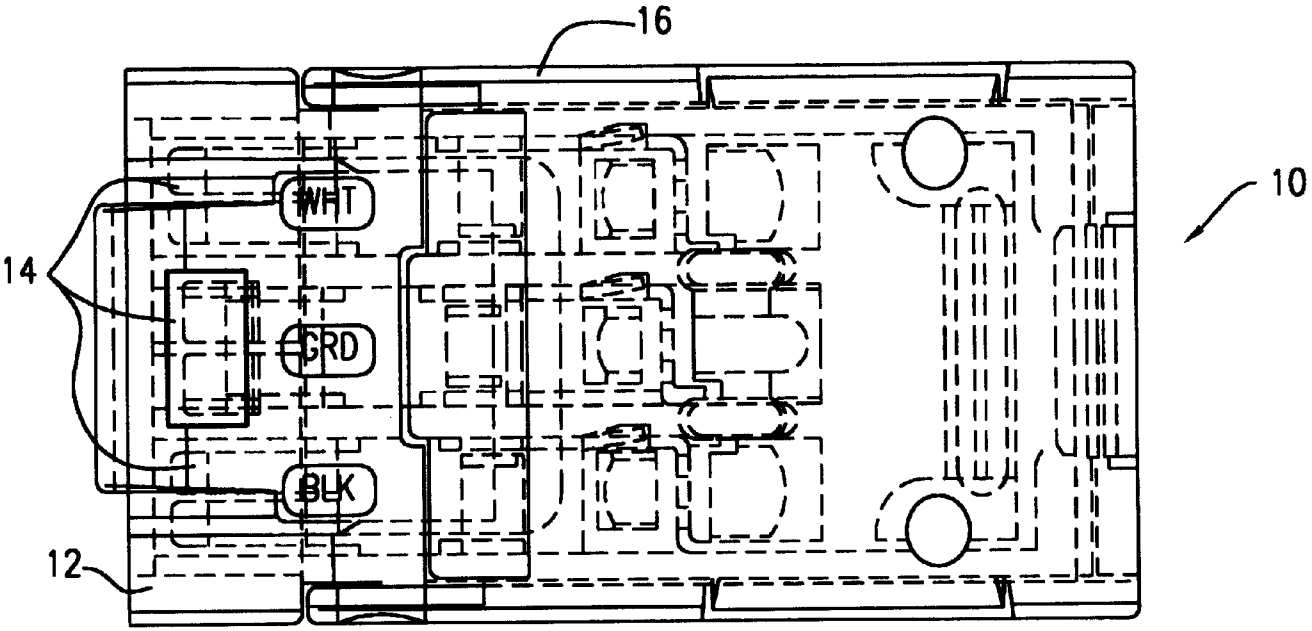
FIG. 1 is a plan view of a cable connector constructed in accordance with a first embodiment of the present invention.
Figure 2:
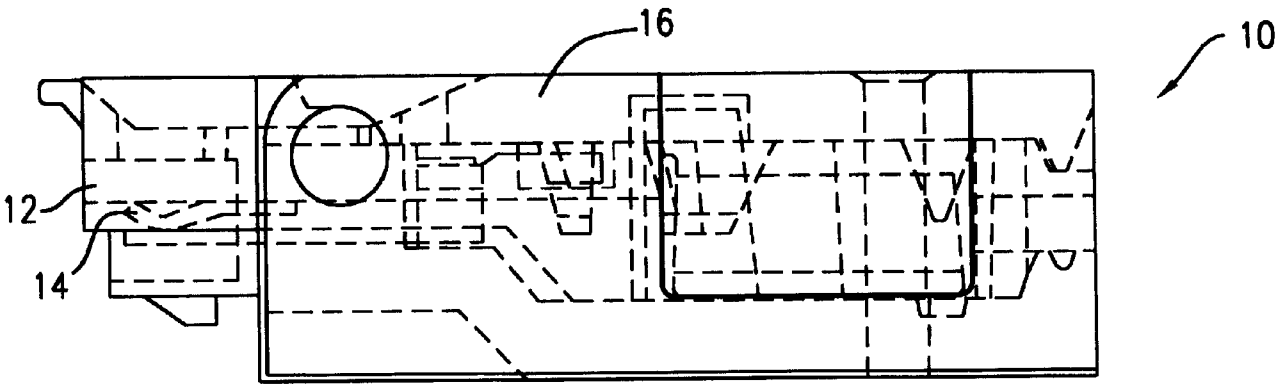
FIG. 2 is a side elevational view of the cable connector shown in FIG. 1.

Referring to FIGS. 1 and 2, there is shown a hermaphroditic cable connector 10 which includes a housing 12, a plurality of blades 14, and a cover 16. Before discussing each element in detail, it is noted that the exemplary embodiment of the hermaphroditic cable connector 10 is based on a design to interlink three-wire Romex cable. However, it should be noted that the invention is not limited to this particular cable.

Figure 3:
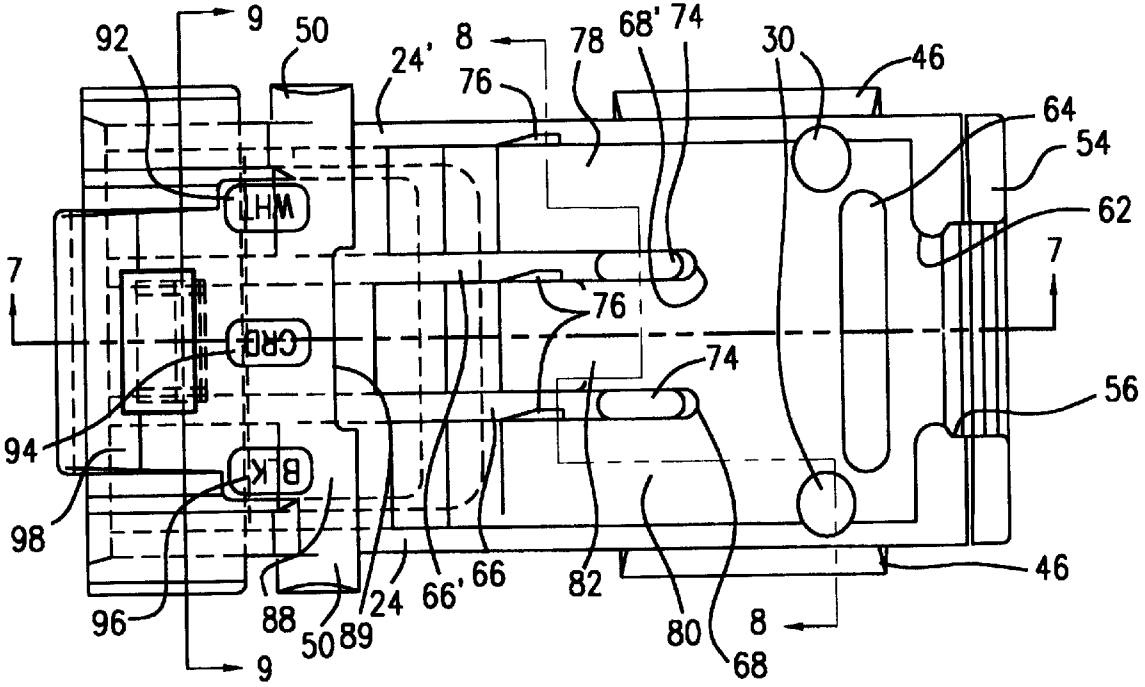
FIG. 3 is a plan view of a housing for the connector shown in FIG. 1.
Figure 4:
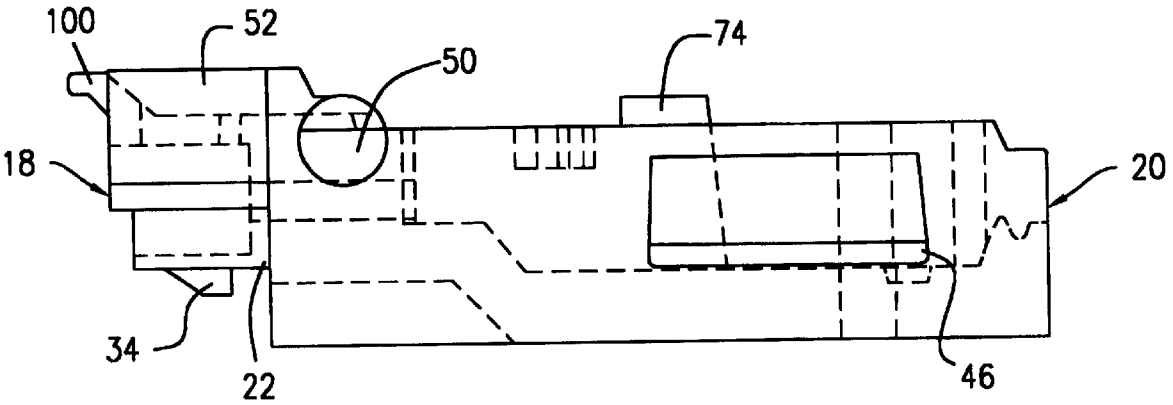
FIG. 4 is a side elevational view of the housing shown in FIG. 3.
Figure 7:
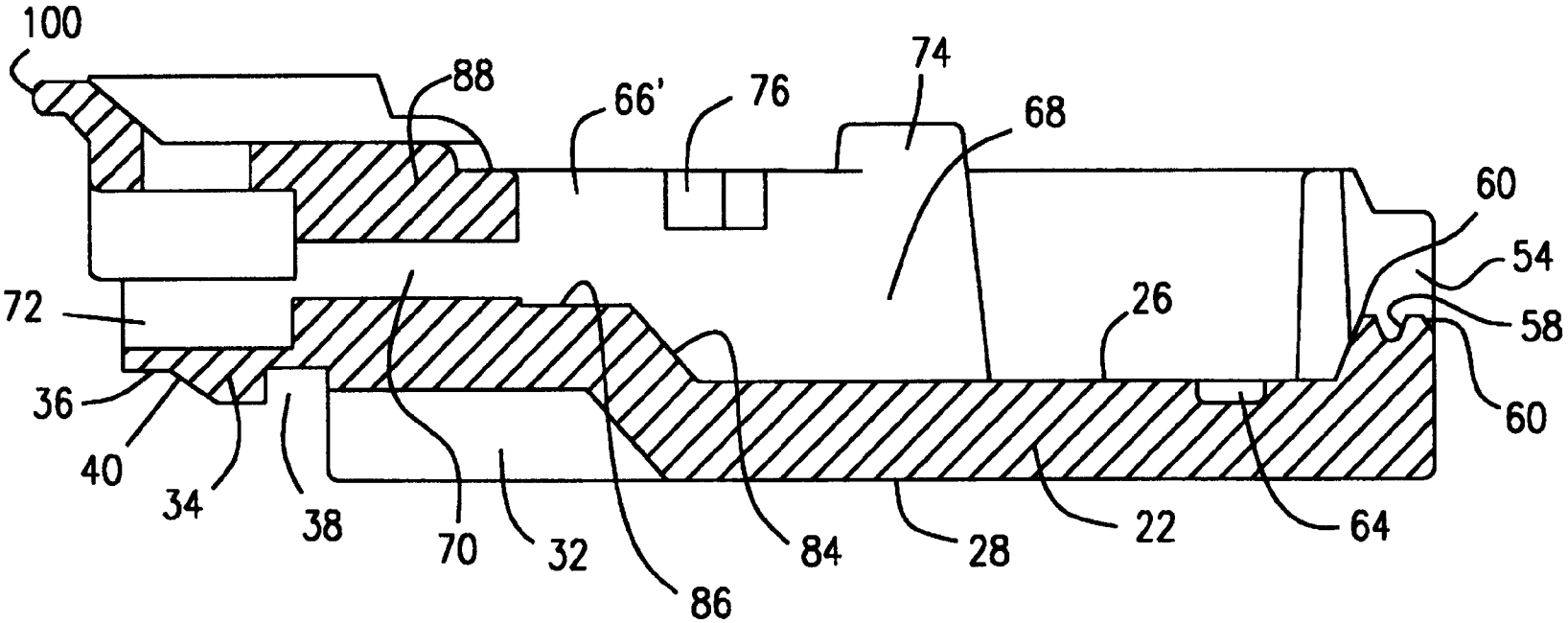
FIG. 7 is a cross-sectional view, taken along section line 7—7 in FIG. 3 and looking in the direction of the arrows, of the housing shown in FIG. 3.
Figure 8:
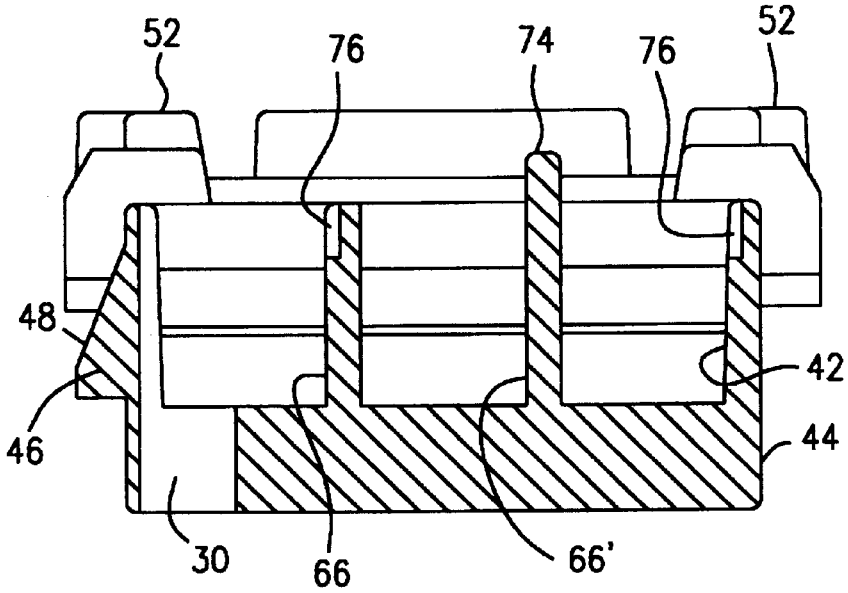
FIG. 8 is a cross-sectional view, taken along section line 8—8 in FIG. 3 and looking in the direction of the arrows, of the housing shown in FIG. 3.
Figure 9:
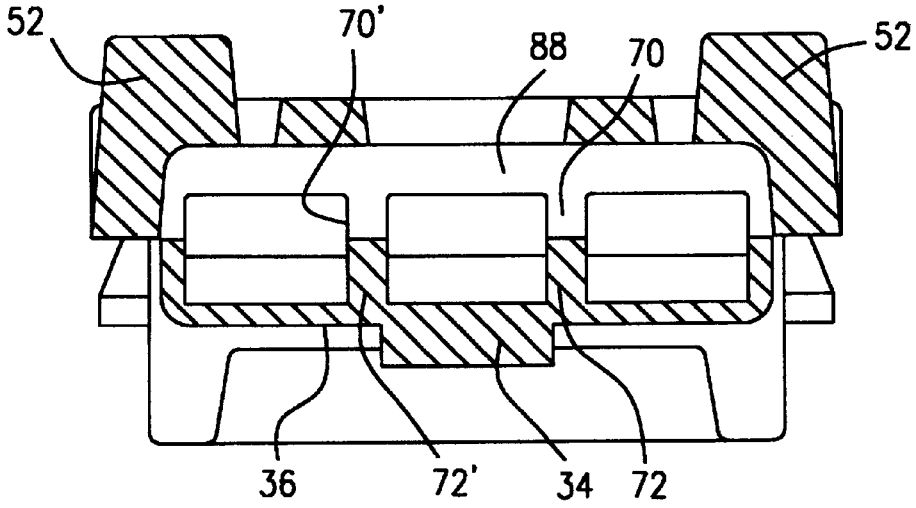
FIG. 9 is a cross-sectional view, taken along section line 9—9 in FIG. 3 and looking in the direction of the arrows, of the housing shown in FIG. 3.
Figure 13:
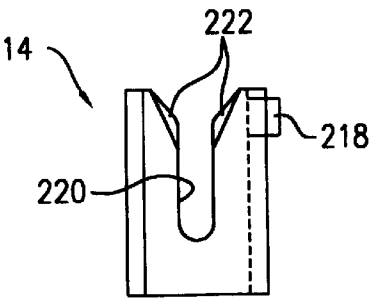
FIG. 13 is a rear elevational view of the blade shown in FIG. 10.
Figure 10:
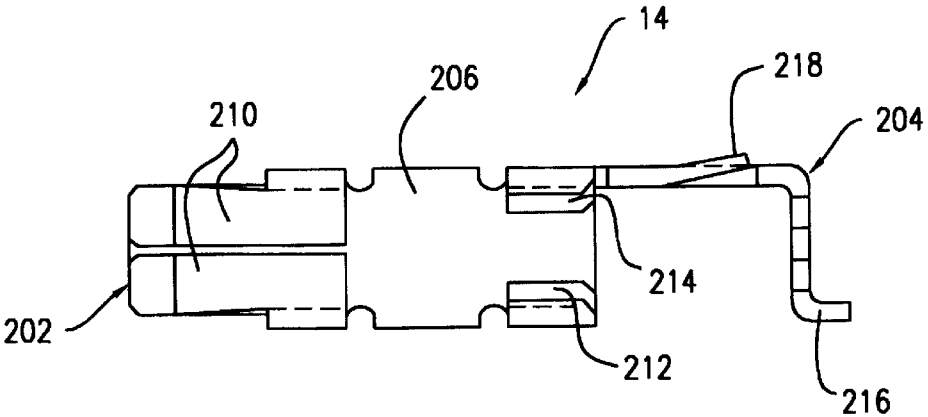
FIG. 10 is a plan view of a blade for the connector shown in FIG. 1.
Figure 11:
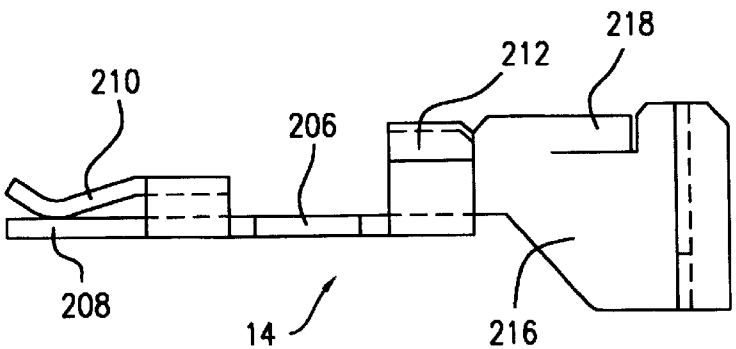
FIG. 11 is a side elevational view of the blade shown in FIG. 10.
Figure 12:
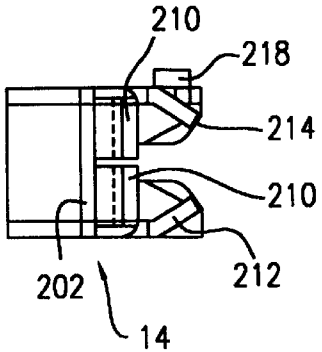
FIG. 12 is a front elevational view of the blade shown in FIG. 10.

Referring now to FIGS. 3–9, in general, and FIGS. 3, 4 and 7, in particular, the housing 12 includes a terminal end 18, a cable end 20, a base 22, and a pair of side walls 24, 24'. The base 22 is generally rectangular with a topside 26 (see FIG. 7), an underside 28, and two apertures 30 therethrough located toward the cable end 20 in close proximity to the side walls 24, 24' (see FIG. 3). The underside 28 (see FIG. 7) includes a depression 32 located toward the terminal end 18 and extending, generally, between the side walls 24, 24'. Near the terminal end 18, the underside 28 has a wedge-shaped catch 34 located equidistantly between the side walls 24, 24' on a recessed surface 36 adjacent to the depression 32, forming a recess 38 between the catch 34 and the depression 32. The catch 34 has an inclined surface 40 oriented toward the terminal end 18. The side walls 24, 24' extend perpendicularly from the topside 26 of the base 22 between the cable end 20 and the terminal end 18 of the housing 12. Each side wall 24, 24' includes an interior surface 42 and an exterior surface 44 (see FIG. 8). Toward the cable end 20, the exterior surface 44 of each side wall 24, 24' includes a wedge-shaped catch 46 with an inclined surface 48 oriented away from the base 22 (see FIG. 8). Toward the terminal end 18, each side wall 24, 24' includes a cylindrical pivot pin 50 oriented generally perpendicular to the exterior surface 42 of the side wall 24, 24' (see FIGS. 3 and 4). At the terminal end 18, each side wall 24, 24' has a shoulder 52 which is separated from the topside 26 of the base 22 (see FIGS. 4 and 9). The exterior side walls 24, 24' are generally mirror images of each other.

With particular reference to FIGS. 3 and 7, at the cable end 20, an end wall 54 extends perpendicularly from the topside 26 of the base 22 between the side walls 24, 24'. The end wall 54 includes a shallow, U-shaped cableway 56 having a groove 58 formed between two ridges 60 which run along the closed end of the cableway 56. There are also ridges 62 along the sides of the cableway 56. The topside 26 of the base 22 has a shallow recess 64 parallel to and near the end wall 54. Two partitions 66, 66' (see FIGS. 6 and 7) extend from near the cable end 20 to the terminal end 18, being normal to the topside 26 and parallel to the side walls 24, 24'. Each of the partitions 66, 66' includes a cable end section 68, 68' (see FIG. 3), an enclosed section 70, 70' and a terminal separator section 72, 72' (see FIGS. 7–9). At the cable end section 68, the partitions 66, 66' include wire guides 74, which are generally rectangular projections extending somewhat above the side walls 24, 24'. Notches 76 are located adjacent to the tops of the partitions 66, 66' and adjacent the top of a corresponding one of the side walls 24, 24'. A white wireway 78 is formed between the notched side wall 24' and the cable end section 68' of the partition 66' (see FIG. 3). Similarly, a black wireway 80 is formed between the other side wall 24 and the cable end section 68 of the partition 66 (see FIG. 3). A ground wireway 82 is formed between the cable end sections 68, 68' of the 20 partitions 66 and 66', respectively (see FIG. 3). Between each of the wireways 78, 80, 82, the topside 26 of the base 22 includes inclined ramps 84 (see FIG. 7) leading to shelves 86 adjacent to the enclosed sections 72, 72' of the partitions 66, 66'.

Figure 5:
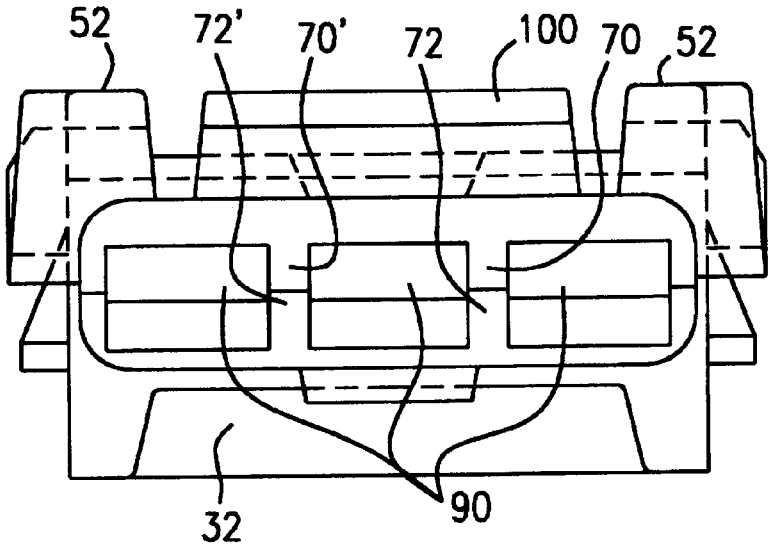
FIG. 5 is a front elevational view of the housing shown in FIG. 3.
Figure 6:
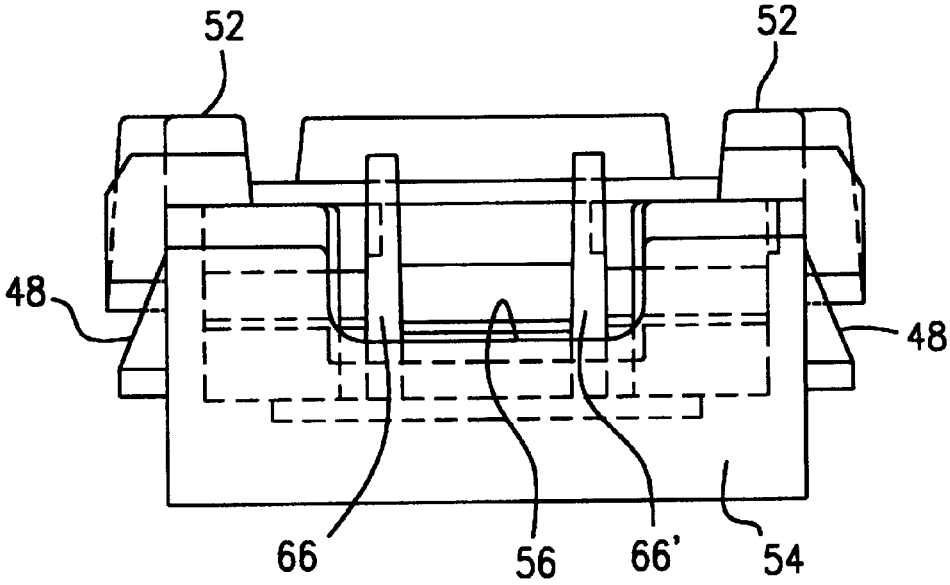
FIG. 6 is a rear elevational view of the housing shown in FIG. 3.

Now, with particular attention to FIGS. 3, 4, 5 and 7, a bridge plate 88 with a centered recess 89 (see FIG. 3) extends between the side walls 24, 24' over the enclosed sections 70, 70' (see FIG. 7) of the partitions 66, 66' forming blade tunnels 90 (see FIG. 5). The bridge plate 88 includes a recessed label 92 bearing the legend WHT, a recessed label 94 bearing the legend BLK, and a recessed label 96 bearing the label GRD adjacent to the corresponding white, black and ground wireways 78, 80, 82 (see FIG. 3). A clasp 98 (see FIG. 3) with a raised tab 100 projects from the terminal end 18 of the housing 12. The raised tab 100 is below the tops of the shoulders 52 of the side walls 24, 24' as shown in FIG. 4, thereby inhibiting inadvertent opening of the clasp 98.

The housing 12 is generally molded from a non-conductive polymeric material. Nylon, either clear or colored, is the preferred material.

Referring now to FIGS. 10–13, the blade 14 includes a contact end 202 and a wire receiving end 204 and a body 206. At the contact end 202, the body 206 has a base contact 208 and a pair of spring contacts 210. Toward the wire receiving end 204, the body 206 has a wire locator 212 and another wire locator 214, which is attached to a support wall 216. The support wall 216 has a locking tab 218 and a piercing channel 220 with chamfered edges 222. The blade 14 is fabricated from a flexible conductive material, preferably metal such as brass, bronze, copper, copper alloy, gold plated metal, silver plated metal or other electrically conducting metallic material. The blade 14 is sized and shaped to fit in the housing 12 as indicated in FIGS. 1 and 2. Namely, the body 206 and the wire receiving end 204 of the spring contacts 210 fit snugly within one of the blade tunnels 90, while the locking tab 218 engages the notch 76 on a side of a corresponding one of the wireways 78, 80, 82.

Referring now to FIGS. 14–22, in general, and to FIGS. 14–19, in particular, the cover 16 includes a hinge end 300, a cable end 302, a cover plate 304, and a pair of side plates 306. The cover plate 304 is generally rectangular with an outside 308, an inside 310, and two apertures 312 therethrough located toward the cable end 302 near the side plates 306. At the hinge end 300, the outside 308 of the cover plate 304 has a chamfered surface 314 and a shallow, U-shaped projection 316. The side plates 306 extend perpendicularly from the inside 310 of the cover plate 304 between the hinge end 300 and the cable end 302 of the cover 16. The generally rectangular side plates 306 include hinges 318 near the hinge end 300 and clasps 320 near the cable end 302. The hinges 318 are sized and shaped to rotatably engage the pivot pins 50 on the housing 12. The clasps 320 are sized and shaped to lockingly engage the catches 46 on the side walls 24, 24' of the housing 12.

Referring particularly to FIGS. 14, 18, 19 and 20, a low, end wall 322 extends perpendicularly from the cable end 302 of the inside 310 of the cover plate 304 between the side plates 306. A wedge-shaped wire guard 324 is centered in the end wall 322. Two screw guards 326 partially surround the apertures 312 and project perpendicularly from the inside 310 of the cover plate 304 to shield mounting screws from cable and wires when attached. Another wedge-shaped wire guard 328 extends between the screw guards 326 on the inside 310 of the cover plate 304.

Figure 14:
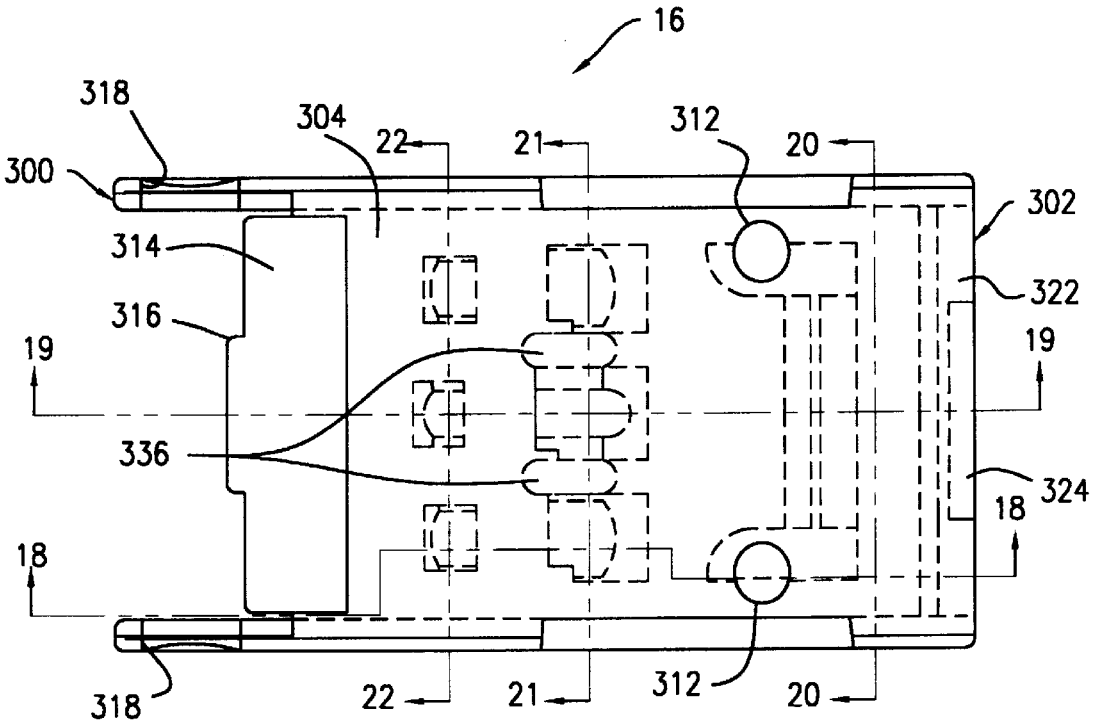
FIG. 14 is a plan view of a cover for the connector shown in FIG. 1.
Figure 15:
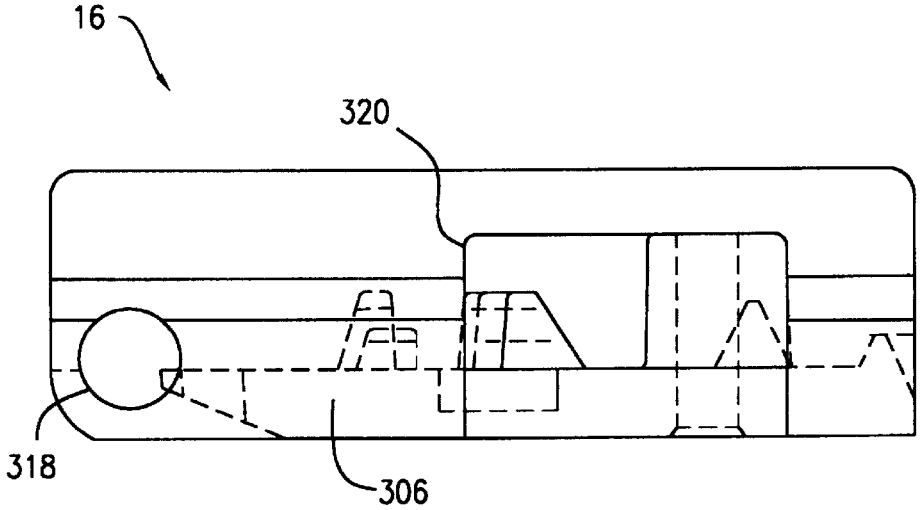
FIG. 15 is a side elevational view of the cover shown in FIG. 14.
Figure 16:
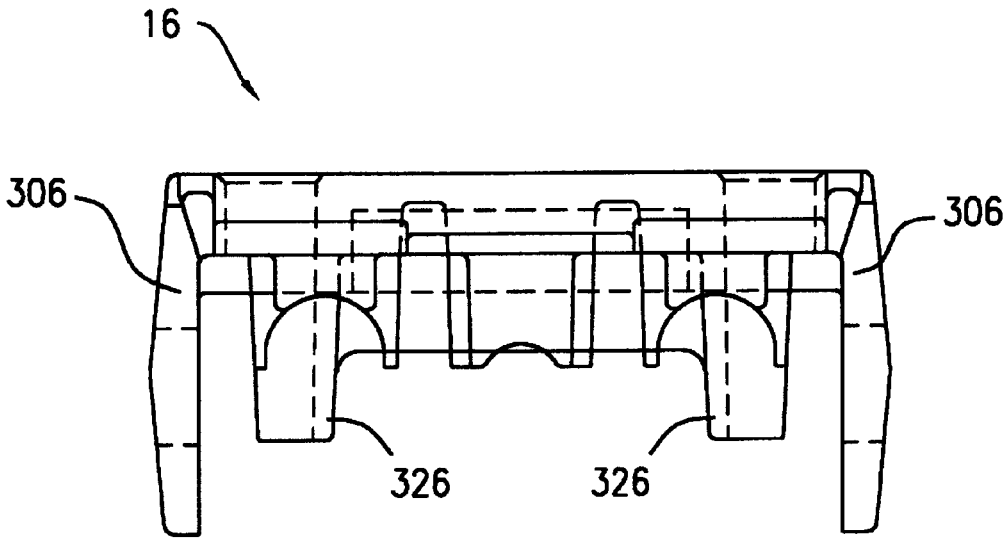
FIG. 16 is a front elevational view of the cover shown in FIG. 14.
Figure 17:
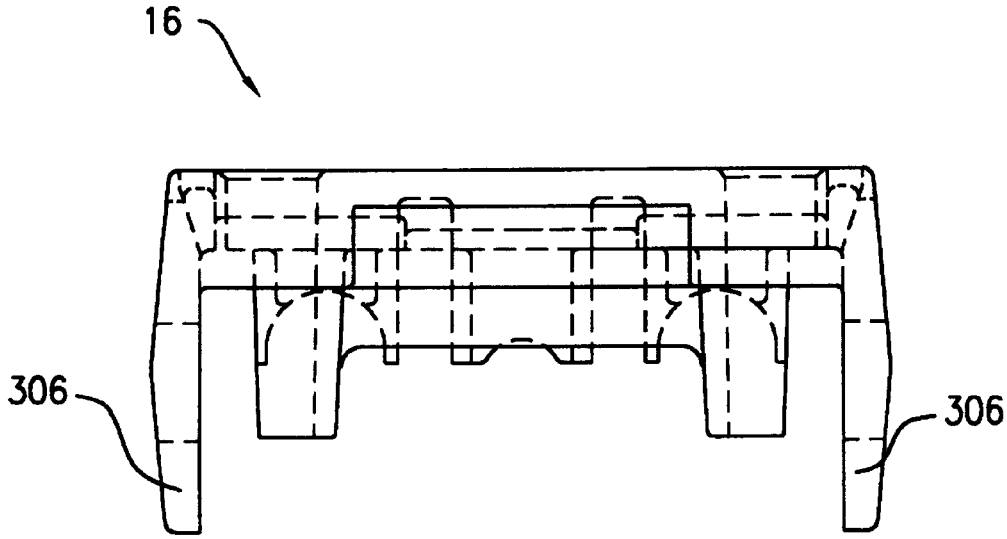
FIG. 17 is a rear elevational view of the cover shown in FIG. 14.
Figure 20:
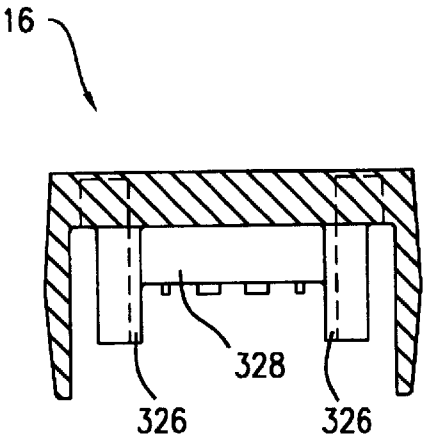
FIG. 20 is a cross-sectional view, taken along section line 20—20 in FIG. 14 and looking in the direction of the arrows, of the cover shown in FIG. 14.
Figure 18:
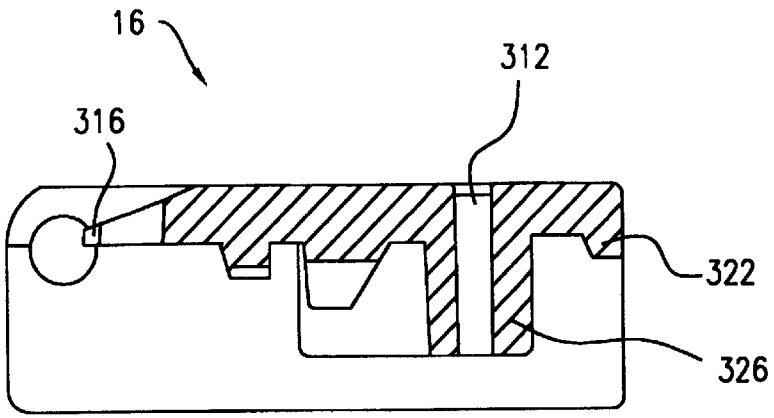
FIG. 18 is a cross-sectional view, taken along section line 18—18 in FIG. 14 and looking in the direction of the arrows, of the cover shown in FIG. 14.
Figure 19:
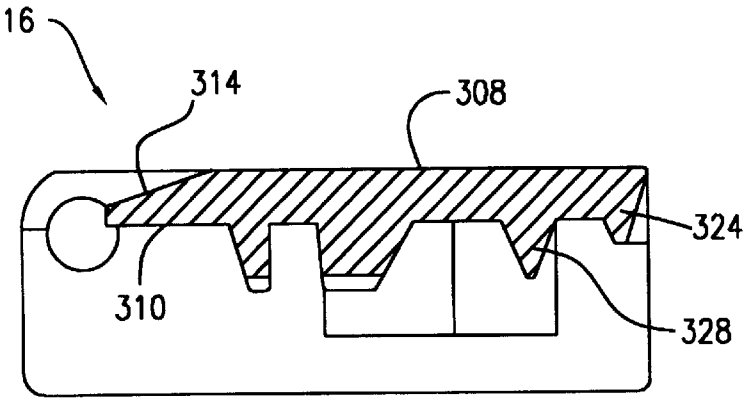
FIG. 19 is a cross-sectional view, taken along section line 19—19 in FIG. 14 and looking in the direction of the arrows, of the cover shown in FIG. 14.
Figure 22:
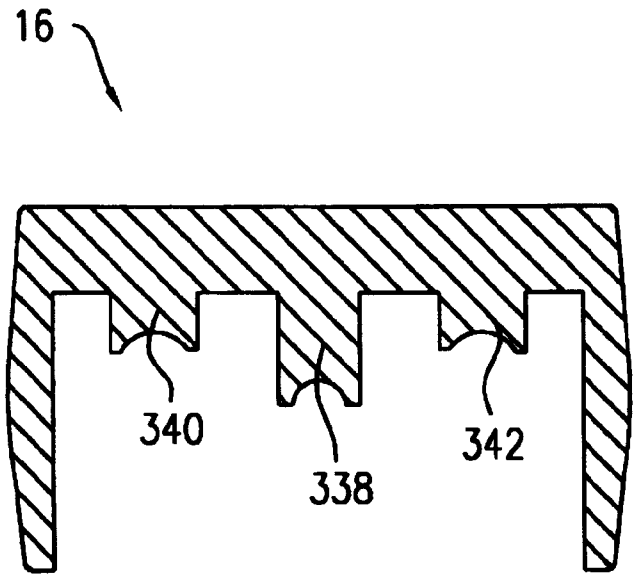
FIG. 22 is a cross-sectional view, taken along section line 22—22 in FIG. 14 and looking in the direction of the arrows, of the cover shown in FIG. 14.
Figure 21:
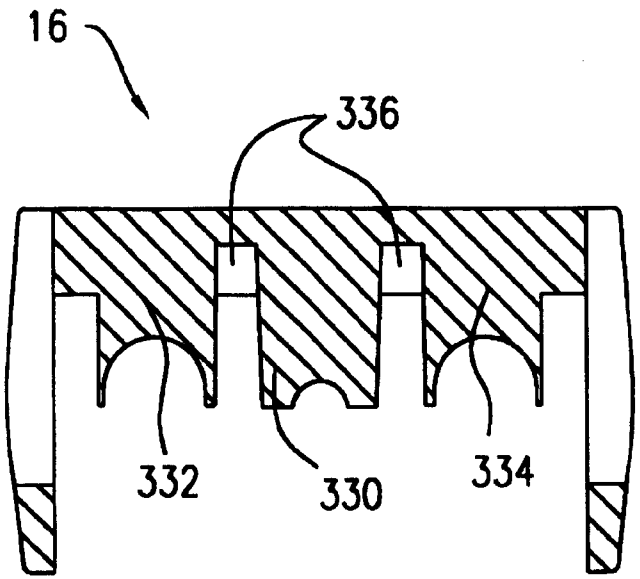
FIG. 21 is a cross-sectional view, taken along section line 21—21 in FIG. 14 and looking in the direction of the arrows, of the cover shown in FIG. 14.

With particular reference to FIGS. 14, 21 and 22, a cable end ground wire driver 330, shaped like a pillar with a circular depression at the top, is located at approximately the middle of the inside 310 of the cover plate 304. Off to one side of the cable end ground wire driver 330 is a similarly shaped cable end black wire driver 332 and a similarly shaped cable end white wire driver 334 is on the opposite side. Oblong recesses 336 in the inside 310 of the cover plate 304 are located between the cable end ground wire driver 330 and both the cable end black wire driver 332 and the cable end white wire driver 334. Aligned with the cable end ground wire driver 330, on the hinge end side, is a similarly shaped hinge end ground wire driver 338. In a like manner, a similarly shaped hinge end black wire driver 340 is aligned with the cable end black wire driver 332 and a hinge end white wire driver 342 is aligned with the cable end white wire driver 334.

The cover 16 is also generally molded from a non-conductive polymeric material. Clear nylon is the preferred material so that the wires in the cable connector 10 can be inspected with the cover 16 in place on the housing 12.

Referring now to FIGS. 1–4, 7, 10, 11, 14 and 15, when the connector 10 is assembled, three blades 14 are positioned in the white, ground and black wireways 78, 80 and 82, respectively, of the housing 12. The notches 76 of the housing 12 engage the locking tabs 218 of the blades 14 as the contact ends 202 of the blades 14 are inserted through the blade tunnels 90. The hinges 318 of the cover 16 are fitted rotatably about the pivot pins 50 on the housing 12. As the cover 16 is closed, the clasps 320 on the cover 16 lockingly engage the catches 46 on the side walls 24, 24' of the housing 12. When the cover 16 is in its closed position, the piercing channels 220 of the blades 14 lie between the cable end wire drivers 330, 332, 334 and the hinge end wire drivers 338, 340, 342; the apertures 312 in the cover 16 align with the apertures 30 in the housing 12 to form mounting screw holes for the connector 10; the wire guard 324 in the end wall 322 of the cover 16 aligns above the groove 58 in the end wall 54 of the housing 12; the wire guard 328 on the cover 16 aligns above the recess 64 in the housing 12; and the projection 316 on the cover 16 mates with the recess 89 in the bridge plate 88 of the housing 12.

Figure 23:
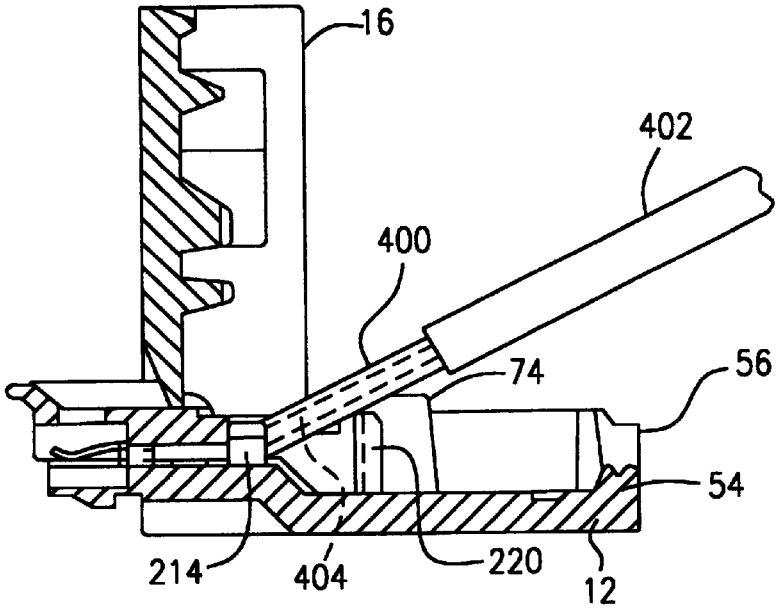
FIG. 23 is a partial cross-sectional view of the connector shown in FIG. 1 with its cover in a fully open position and an insulated wire of a cable inserted in an initial position.
Figure 24:
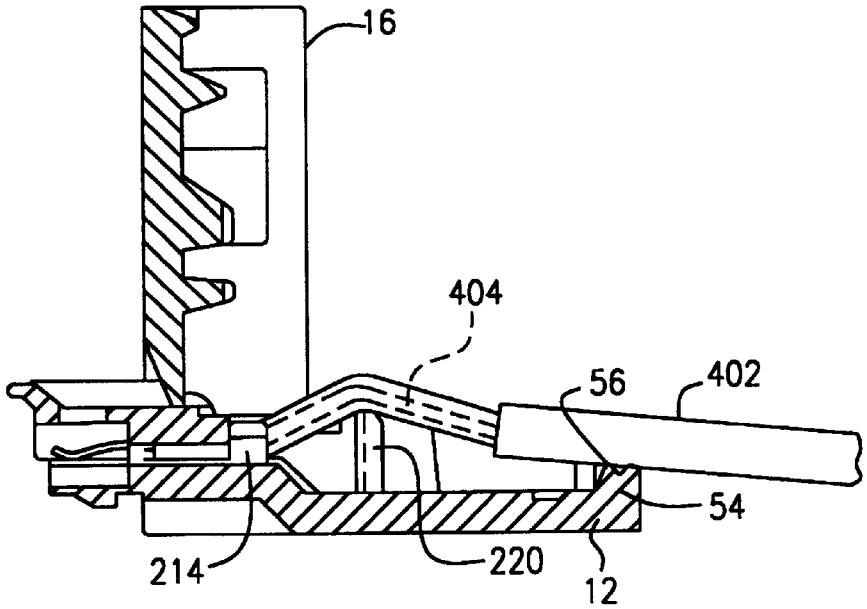
FIG. 24 is a partial cross-sectional view of the connector shown in FIG. 1 with its cover in a fully open position and an insulated wire of a cable bent in an intermediate position.
Figure 26:
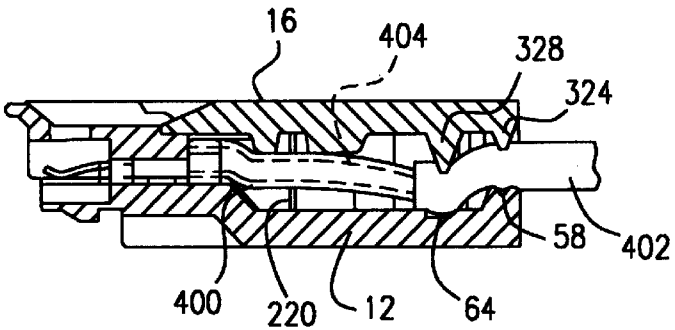
FIG. 26 is a partial cross-sectional view of the connector shown in FIG. 1 with its cover in a fully closed position after driving the insulated wire of a cable into a final position.
Figure 25:
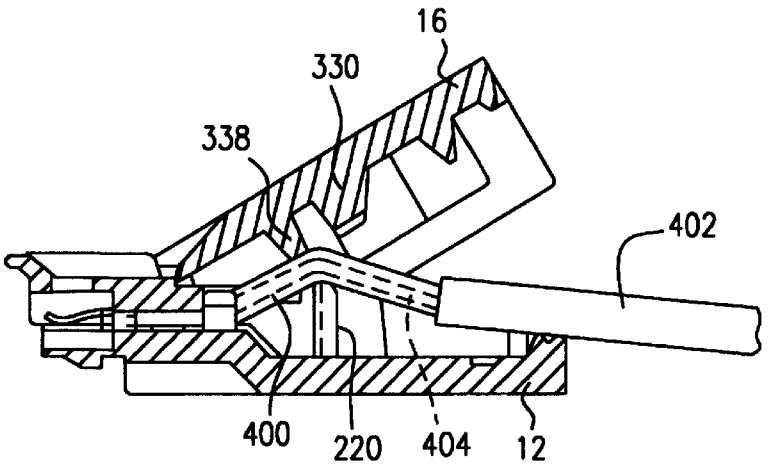
FIG. 25 is a partial cross-sectional view of the connector shown in FIG. 1 with its cover in a partially closed position making contact with the insulated wire of a cable bent in an intermediate position.

The operation of the connector 10 is illustrated in FIGS. 23–27 in connection with an electrical cable 402 having three insulated wires 400 (only one of which is shown in FIGS. 23–27) with metallic wires 404 therein. The initial position of the connector 10 is as shown in FIG. 23, with the cover 16 in place in its fully open position. Initial preparation of the cable 402 includes removing the outer sheathing to expose the three individual insulated wires 400 contained therein. The three insulated wires 400 are then separated and the ends of the insulated wires 400 are inserted from the cable end 20 of the housing 12 into the wire locators 214, as shown in FIG. 23. Note that the wire guides 74 insure that the individual insulated wires are properly guided to the piercing channels 220 in the blades 14. As shown in FIG. 24, the insulated wires 400 are bent over the piercing channels 220 as the cable 402 is positioned in the cableway 56 in the end wall 54 of the housing 12. FIG. 25 shows the cover 16 being lowered so that each of the hinge end wire drivers 338, 340, 342 contacts one of the insulated wires 400 on one side of one of the piercing channels 220 and each of the cable end wire drivers 330, 332, 334 contacts one of the insulated wires 400 on the other side of one of the piercing channels 220 to drive the insulated wire 400 into the chamfered edges 222 of the piercing channels 220 to pierce the wire insulation of the insulated wires 400. In FIG. 26, the cover 16 is in its closed position and each of the insulated wires 400 is seated in a corresponding one of the piercing channels 220 such that each of the metallic wires 404 is in direct contact with the edges of a corresponding one of the piercing channels 220. Also in FIG. 26, the wire guards 324 and 328 compress the cable 402 into the groove 58 in the cableway 56 and the recess 64, respectively, to provide strain relief for the insulated wires 400.

Figure 27:
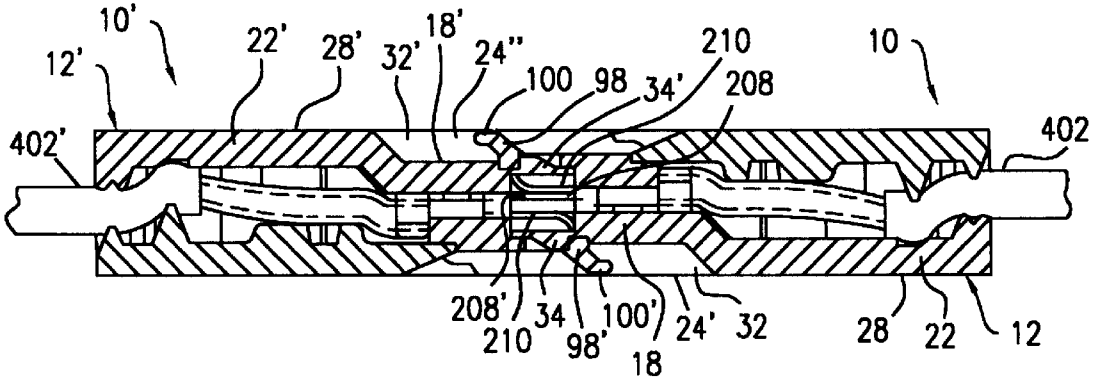
FIG. 27 is a partial cross-sectional view of two mated hermaphroditic cable connectors shown interlinking two associated cables.
Figure 28:
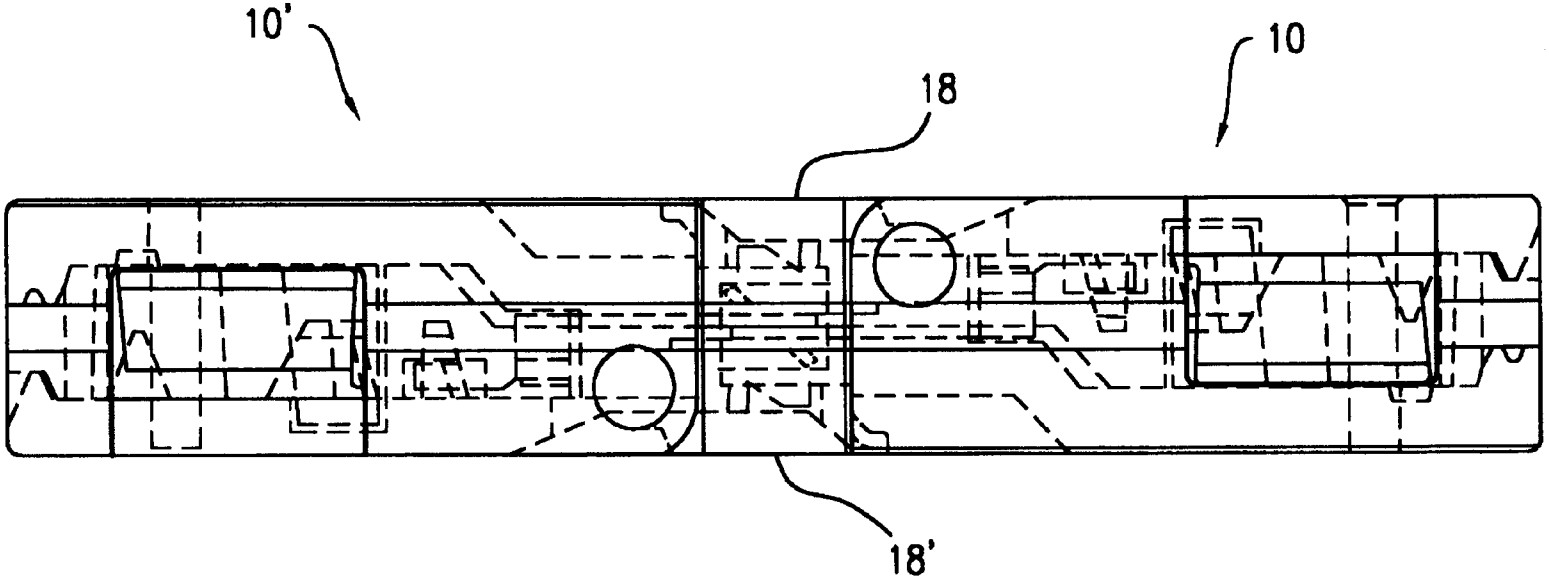
FIG. 28 is a side elevational view of two mated hermaphroditic connectors without associated cables.

FIGS. 27 and 28 illustrate the mating of two hermaphroditic cable connectors 10 and 10'. In mating, one connector 10 is in an initial position, while the other connector 10' is flipped over 180 degrees, so that the connectors 10 and 10' can be joined together terminal end 18 to terminal end 18'. Note that in the mated position, the clasps 98 and 98' on the terminal ends 18 and 18' of each of the housings 12 and 12' lock on the catches 34' and 34 on the undersides 28' and 28 of the housings 12' and 12, respectively. In the locked position, the raised tabs 100 and 100' of the clasps 98 and 98' extend into the depressions 32 and 32' on the undersides 28 and 28' of the bases 22 and 22' of the housings 12 and 12' below the edges of the side walls 24', 24", which prevents inadvertent opening of the clasps 98 and 98'. Also note that the base contacts 208 of each blade 14 fit between the base contacts 208' and spring contacts 210' of the mating blades 14', while the terminal separator sections 72 of the partitions 66, 66' overlap the mating terminal separator sections (not shown) of the connector 10' to provide insulating barriers between adjacent pairs of mating contacts 208, 210 and 208', 210'.

Figure 29:
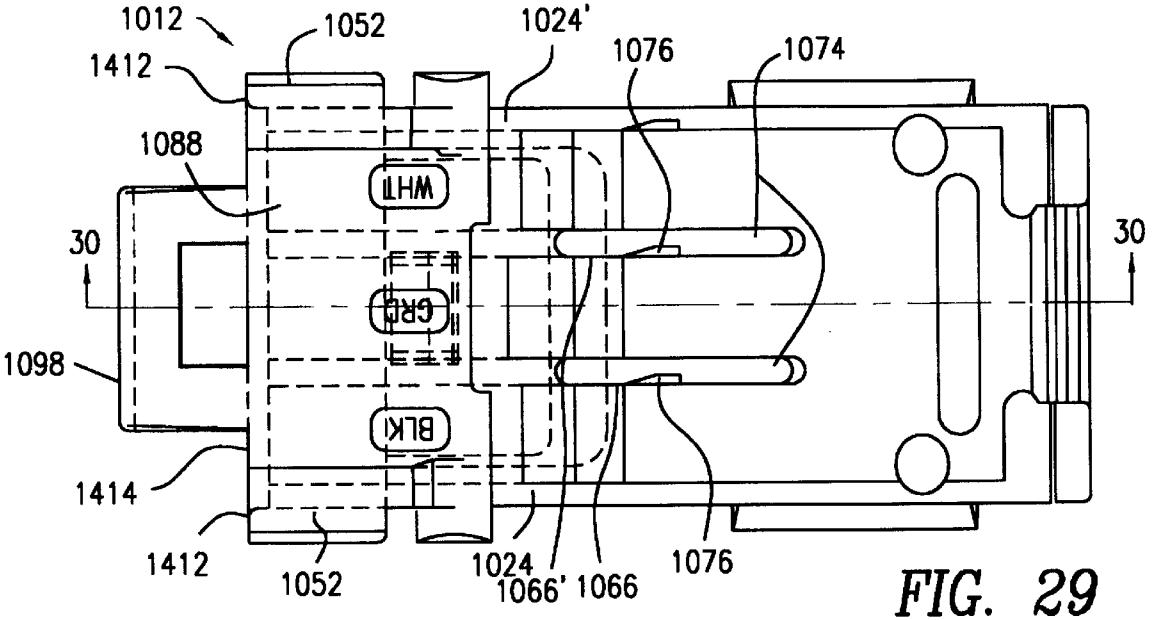
FIG. 29 is a top plan view of a housing of a cable connector constructed in accordance with a second embodiment of the present invention.
Figure 30:
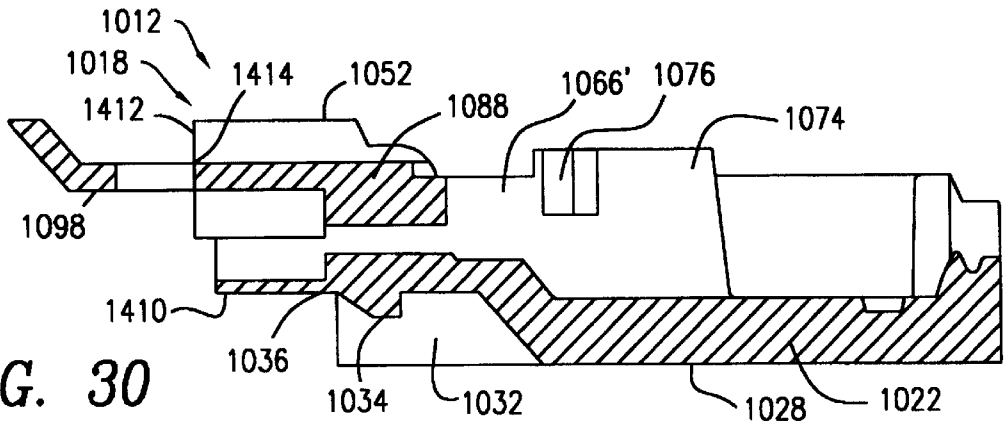
FIG. 30 is a cross-sectional view, taken along section line 30—30 and looking in the direction of the arrows, of the housing shown in FIG. 29.

FIGS. 29 and 30 illustrate a hermaphroditic cable connector constructed in accordance with a second embodiment of the present invention. Elements illustrated in FIGS. 29 and 30, which correspond, either identically or substantially, to the elements described above with respect to the embodiment of FIGS. 1–28, have been designated by corresponding reference numerals increased by one thousand. Unless otherwise stated, the hermaphroditic cable connector of FIGS. 29 and 30 is constructed, assembled and operated in the same basic manner as the embodiment of FIGS. 1–28.

With reference to FIGS. 29 and 30, the hermaphroditic cable connector includes a housing 1012. The housing 1012 has a base 1022, a pair of side walls 1024, 1024' and an underside 1028. The underside 1028 includes a recessed surface 1036, which has a free end 1410 located at a terminal end 1018 of the housing 1012, a depression 1032, which is formed between the side walls 1024, 1024' adjacent the terminal end 1018, and a wedge-shaped catch 1034 which is formed on the recessed surface 1036 and which is located within the depression 1032 between the side walls 1024, 1024'. Each of the side walls 1024, 1024' is provided with a shoulder 1052 extending from a corresponding one of the side walls 1024, 1024' and terminating at an end 1412 slightly beyond the free end 1410 of the recessed surface 1036. A bridge plate 1088 extends between the shoulders 1052. More particularly, the bridge plate 1088 terminates at an end 1414 which is substantially aligned with the ends 1412 of the shoulders 1052. The bridge plate 1088 is also integrally connected to the shoulders 1052. A clasp 1098 projects from the end 1414 of the blade plate 1088.

Still referring to FIGS. 29 and 30, the housing 1012 also includes a pair of partitions 1066, 1066' provided with wire guides 1074 at upper ends thereof. Each of the wire guides 1074 extends from an end of a corresponding one of the partitions 1066, 1066' towards the terminal end 1018 of the housing 1012 and is sized and shaped so as to be received in a corresponding one of oblong recesses formed in a cover (not shown in FIGS. 29 and 30). Each of the partitions 1066, 1066' is also provided with a notch 1076 extending downwardly from an upper end of a corresponding one of the wire guides 1074.

It should be noted that the embodiments described herein are merely exemplary and that a person skilled in the art may make many variations and modifications without departing from the spirit and scope of the invention. All such variations and modifications are intended to be included within the scope of the invention as defined in the appended claims.

I claim:

1. A connecting device for connecting an electrical cable, which includes a plurality of wires, to another electrical cable, said device comprising a housing having an open side for insertion of the electrical cable into said housing, said housing having a connecting end, which is sized and shaped so as to be removably connected to a connecting end of a second connecting device, and an opposite end, which includes first receiving means for receiving at least a portion of the electrical cable inserted into said housing, said opposite end of said housing including an end wall, said first receiving means including a slot formed in said end wall, said slot having an open end adjacent said open side of said housing for receiving the electrical cable inserted into said housing, said housing including second receiving means, located adjacent said connecting end, for receiving a plurality of connecting blades sized and shaped so as to engage connecting blades of said second connecting device and to receive the plurality of wires of the electrical cable inserted into said housing; and a cover for covering said open side of said housing, said cover including a first end, which is pivotally connected to said connecting end of said housing, and a second end, which is located opposite said first end, said cover being pivotally movable relative to said housing between an open position, in which said open side of said housing is unobstructed by said cover for insertion of the plurality of wires of the electrical cable into said blades, and a closed position, in which said open side of said housing is closed off by said cover, said first receiving means being unobstructed by said cover when said cover is in its said open position, whereby the electrical cable inserted into said housing can be laid in said first receiving means while said cover is attached to said housing and then secured to said housing in response to the pivotal movement of said cover from its said open position to its said closed position, said open end of said slot being unobstructed by said second end of said cover when said cover is in said open position and being abutted by said second end when said cover is in said closed position; and gripping means for gripping the electrical cable inserted into said housing in a strain-relieving manner in response to pivotal movement of said cover from said open position to said closed position.

2. The device of claim 1, wherein said housing includes a base, which extends from said connecting end to said opposite end and which is located opposite said open side of said housing, and a pair of side walls, which extend between said connecting end and said opposite end and which project from said base, said end wall projecting from said base and extending between said side walls along said opposite end of said housing, and said end wall and said side walls cooperating to define said open side of said housing.

3. The device of claim 2, wherein said cover includes a cover plate, which extends between said first and second ends and which is sized and shaped so as to close off said open side of said housing when said cover is in said closed position, and a pair of side plates, which depend from said cover plate and which are sized and shaped so as to position said side walls between said side plates when said cover is in said closed position.

4. The device of claim 3, wherein said housing includes a pair of pivot pins, each of which extends outwardly from a corresponding one of said side walls and each of which is located at said connecting end of said housing; and wherein said cover includes a pair of hinges, each of which is formed in a corresponding one of said side plates at said first end of said cover and each of which is sized and shaped so as to rotatably receive a corresponding one of said pivot pins.

5. The device of claim 4, further comprising locking means for locking said cover in said closed position.

6. The device of claim 5, wherein said locking means includes a locking member, which is formed on each of said side walls adjacent said opposite end of said housing, and a clasp which is formed in each of said side plates adjacent said second end of said cover.

7. The device of claim 6, wherein each of said locking members is sized and shaped so as to engage a corresponding one of said clasps in an interlocking manner.

8. The device of claim 2, wherein said gripping means includes a first member formed on said cover and sized and shaped so as to urge an electrical cable positioned in said slot against said end wall when said cover is pivotally moved from said open position to said closed position.

9. The device of claim 8, wherein said slot includes a first groove formed in said end wall and located opposite said open end of said slot; and wherein said first member depends from said second end of said cover and is sized and shaped so as to abut against said open end of said slot when said cover is in said closed position such that at least a portion of an electrical cable positioned in said slot is compressed into said first groove by said first member.

10. The device of claim 9, wherein said gripping means includes a second member, which depends from said cover and which is positioned between said first and second ends, and a second groove which is formed in said base between said connecting end and said opposite end of said housing, said second member being sized and shaped so as to compress at least a portion of an electrical cable positioned in said housing into said second groove when said cover is in said second position.

11. The device of claim 5, further comprising locking means for releasably locking said connecting end of said housing to a connecting end of an identical connecting device.

12. The device of claim 11, wherein said locking means includes a first locking member and a second locking member formed on said housing adjacent said connecting end.

13. The device of claim 12, wherein said first locking member is sized and shaped so as to releasably interlock with a second locking member of an identical connecting device; and wherein said second locking member is sized and shaped so as to releasably interlock with a first locking member of an identical connecting device.

14. The device of claim 13, wherein said housing includes a base having a depression therein adjacent said connecting end of said housing, said first locking member being formed on said base in such a manner that a second locking member of an identical connecting device interlocked to said first locking member is substantially tucked in said depression, thereby inhibiting inadvertent disengagement of said first locking member from an interlocked second locking member of an identical connecting device.

15. The device of claim 13, wherein said housing includes a pair of side walls projecting from said base, said side walls cooperating with said base so as to define said depression.

16. The device of claim 15, wherein said housing includes a plate located at said connecting end above said base; wherein said first locking member includes a catch formed on said base adjacent said depression; and wherein said second locking member includes a clasp extending from said plate away from said opposite end of said housing.

17. A connecting device for connecting an electrical cable, which includes a plurality of wires, to another electrical cable, said device comprising a housing having an open side for insertion of the electrical cable into said housing, said housing having a connecting end, which is sized and shaped so as to be removably connected to a connecting end of a second connecting device, and an opposite end, which includes first receiving means for receiving at least a portion of the electrical cable inserted into said housing, said housing including second receiving means, located adjacent said connecting end, for receiving a plurality of connecting blades sized and shaped so as to engage connecting blades of said second connecting device and to receive the plurality of wires of the electrical cable inserted into said housing, each of said blades including third receiving means for receiving an end of a wire of the electrical cable inserted into said housing, said third receiving means being sized and shaped so as to retain the wire of the electrical cable received therein in proper position relative to said housing and including a pair of wire locators formed on a corresponding one of said blades; and a cover for covering said open side of said housing, said cover being pivotally connected to said housing remote from said opposite end thereof such that said cover is pivotally movable relative to said housing between an open position, in which said open side of said housing is unobstructed by said cover for insertion of the plurality of wires of the electrical cable into said blades, and a closed position, in which said open side of said housing is closed off by said cover, said first receiving means being unobstructed by said cover when said cover is in its said open position, whereby the electrical cable inserted into said housing can be laid in said first receiving means while said cover is attached to said housing and then secured to said housing in response to the pivotal movement of said cover from its said open position to its said closed position.

18. The device of claim 17, wherein each of said blades includes a body having a contact end, which is sized and shaped so as to engage a contact end of an identical connecting blade, and a receiving end, which is located opposite a corresponding one of said contact ends, each of said pairs of wire locators being positioned between a corresponding one of said receiving ends and a corresponding one of said contact ends.

19. The device of claim 18, wherein each of said blades includes a piercing channel formed on a corresponding one of said receiving ends and sized and shaped so as to receive a wire of an electrical cable inserted into said housing.

20. The device of claim 19, wherein each of said piercing channels includes a chamfered edges on an upper end thereof.

21. The device of claim 20, wherein said cover includes driving means for driving each of a plurality of wires of an electrical cable positioned in said housing into a corresponding one of said piercing channels.

22. The device of claim 21, wherein said driving means includes an array of pairs of drivers, said pairs of drivers depending from said cover in such a manner that each of said piercing channels is positioned between the drivers of a corresponding one of said pairs of drivers when said cover is in said closed position.

23. A connecting device for connecting an electrical cable, which includes a plurality of wires, to another electrical cable, said device comprising a housing having an open side for insertion of the electrical cable into said housing, said housing having a connecting end, which is sized and shaped so as to be removably connected to a connecting end of a second connecting device, and an opposite end, which includes first receiving means for receiving at least a portion of the electrical cable inserted into said housing, said housing including second receiving means, located adjacent said connecting end, for receiving a plurality of connecting blades sized and shaped so as to engage connecting blades of said second connecting device and to receive the plurality of wires of the electrical cable inserted into said housing, said second receiving means including a plurality of receiving channels formed in said housing adjacent said connecting end, each of said receiving channels being sized and shaped so as to receive a corresponding one of said blades, said housing including a base and a pair of side walls projecting upwardly from said base, said second receiving means including a pair of partitions positioned between said side walls, said partitions projecting upwardly from said base and extending from said connecting end of said housing towards said opposite end of said housing, one of said partitions being positioned adjacent one of said side walls; and the other of said partitions being positioned adjacent the other of said side walls, said one side wall and said one partition cooperating to define a first one of said receiving channels, said one partition and said other partition cooperating to define a second one of said receiving channels, and said other partition and said other side wall cooperating to define a third one of said receiving channels; and a cover for covering said open side of said housing, said cover being pivotally connected to said housing remote from said opposite end thereof such that said cover is pivotally movable relative to said housing between an open position, in which said open side of said housing is unobstructed by said cover for insertion of the plurality of wires of the electrical cable into said blades, and a closed position, in which said open side of said housing is closed off by said cover, said first receiving means being unobstructed by said cover when said cover is in its said open position, whereby the electrical cable inserted into said housing can be laid in said first receiving means while said cover is attached to said housing and then secured to said housing in response to the pivotal movement of said cover from its said open position to its said closed position.

24. The device of claim 23, wherein said housing includes retaining means for retaining each of said blades in a corresponding one of said receiving channels.

25. The device of claim 24, wherein said retaining means includes a first notch, which is formed in a side of said one side wall adjacent said first one of said receiving channels, a second notch, which is formed in a side of said one partition adjacent said second one of said receiving channels, and a third notch, which is formed in a side of said other partition adjacent said third one of said receiving channels.

26. The device of claim 25, wherein each of said blades has a locking tab sized and shaped so as to be received in a corresponding one of said first, second and third notches.

* * * * *